US009930739B2

(12) United States Patent
Moskowitz

(10) Patent No.: US 9,930,739 B2
(45) Date of Patent: Mar. 27, 2018

(54) CURRENT SHARING CIRCUIT FOR LED LIGHTING

(75) Inventor: Warren P. Moskowitz, Ipswitch, MA (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 13/597,336

(22) Filed: Aug. 29, 2012

(65) Prior Publication Data

US 2014/0062314 A1 Mar. 6, 2014

(51) Int. Cl.
*H05B 37/02* (2006.01)
*H05B 33/08* (2006.01)

(52) U.S. Cl.
CPC ..... *H05B 33/0827* (2013.01); *H05B 33/089* (2013.01)

(58) Field of Classification Search
CPC ... H05B 37/02; H05B 33/0827; H05B 33/089
USPC ..... 315/185
See application file for complete search history.

(56) References Cited

U.S. PATENT DOCUMENTS

2010/0109557 A1 5/2010 Bouchard
2011/0080115 A1* 4/2011 Ge ..... H05B 33/0812 315/294

FOREIGN PATENT DOCUMENTS

DE 102010048362 A1 * 4/2012 ..... H05B 33/0827
EP 2429261 A1 * 3/2012 ..... H05B 33/0827
WO 2012/095680 A1 7/2012
WO WO 2012095680 A1 * 7/2012 ..... G05F 3/26

OTHER PUBLICATIONS

Zetex, ZXMN6A11DN8, Sep. 2006, Issue 3.*
Machine Translation of DE102010048362A1 from European Patent Office, dated Mar. 10, 2017, 16 pages.
Morrish, Ian, Communication pursuant to Article 94(3) from the European Patent Office, for counterpart application EP13181997.1, dated Dec. 23, 2016, European Patent Office, Dresden, DE, 6 pages.
Office Action and translation from the State Intellectual Property Office, P.R. China, for counterpart application CN201310384159.3, dated Jan. 18, 2017, State Intellectual Property Office, P.R. China, Beijing, CN, 26 pages.

* cited by examiner

*Primary Examiner* — Hoang Nguyen
*Assistant Examiner* — Jae Kim
(74) *Attorney, Agent, or Firm* — Yutian Ling

(57) ABSTRACT

Techniques and corresponding circuitry are disclosed for providing active current sharing in lighting applications. In some embodiments, an active current sharing circuit is provided that includes a series-pass sub-circuit, such as a transistor or transistor circuit (or other active series-pass circuit), for each LED string. In addition, each string has a current sense sub-circuit for sensing current of that string. A monitor and control sub-circuit operates in conjunction with the series-pass sub-circuit to maintain the sensed current equal to a common reference level. In some embodiments, the common reference level is controlled to maintain the lowest series-pass element voltage close to or equal to zero volts (−0.25 VDC to +0.25 VDC).

8 Claims, 14 Drawing Sheets

CURRENT SHARING CIRCUIT FOR LED LIGHTING

FIELD OF THE INVENTION

The invention relates to electronic circuitry, and more particularly, to techniques for sharing current among parallel LED strings of a lighting apparatus.

BACKGROUND

As is known, light emitting diodes (LEDs) are devices that generate light when current/voltage is applied to the device. LED light output is proportional to the LED current, and thus, a current source is generally used to drive the LEDs for a given application. LEDs can be used in any number of applications (e.g., automotive headlamps, residential and commercial lighting, optoelectronics circuitry, and manufacturing processes), and provide a number of benefits such as long operation life, high efficiency and low profile, relative to other lighting technologies.

In many applications, an array of LEDs is provided where the array includes a plurality of LED strings connected in parallel, where each string includes a number of serially connected LEDs. Due to the wide unit-to-unit variation of LED forward voltage, parallel LED strings require a current limiter or other current regulator in series with each string to force current sharing amongst the strings. For instance, resistors are commonly used as current limiters. However, there are a number of non-trivial limitations associated with such current sharing techniques.

DETAILED DESCRIPTION

Figure 1:
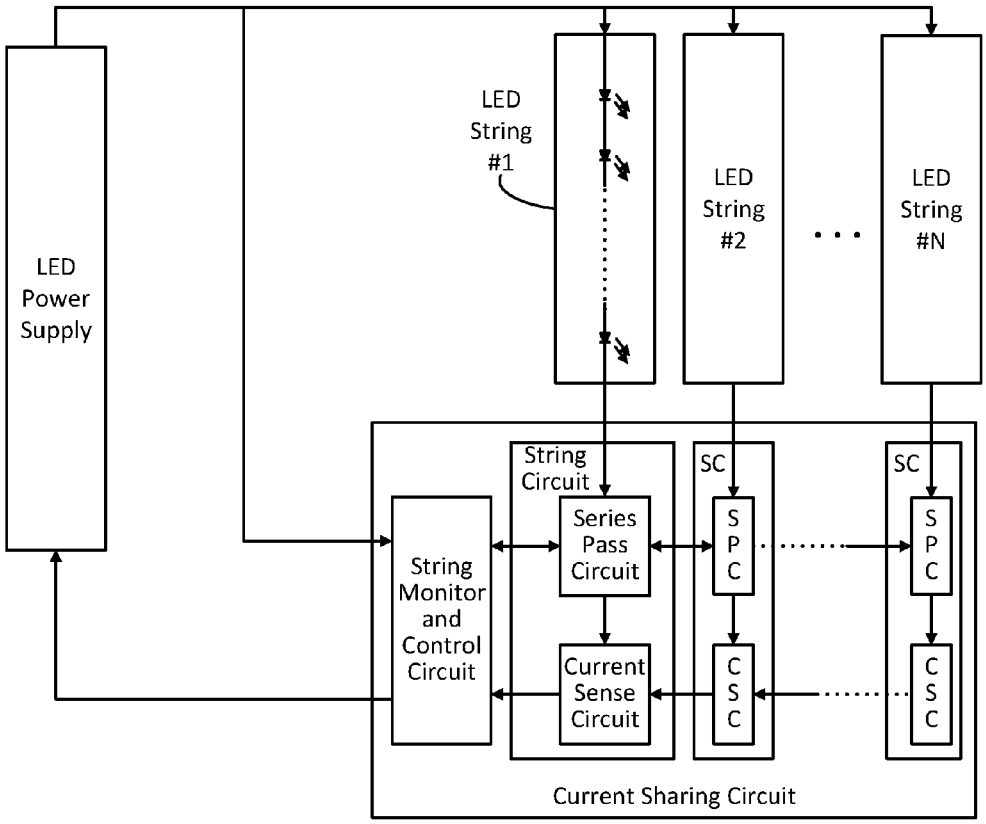
FIG. 1 illustrates a block diagram of an LED device having a current sharing circuit configured in accordance with an embodiment of the present invention.

Techniques and corresponding circuitry are disclosed for providing active current sharing in lighting applications. The techniques can be used, for instance, to minimize or otherwise reduce current differences between parallel LED strings of a given lighting apparatus while further minimizing or otherwise reducing power dissipation. In some embodiments, an active current sharing circuit is provided that includes a series-pass sub-circuit, such as a transistor or transistor circuit (or other active series-pass circuit), for each LED string. In addition, each string has a current sense sub-circuit for sensing current of that string. A monitor and control sub-circuit operates in conjunction with the series-pass sub-circuit to maintain the sensed current equal to a common reference level, wherein the common reference level is controlled to maintain the lowest series-pass element voltage close to or equal to zero volts. Numerous configurations will be apparent in light of this disclosure.

General Overview

As previously explained, there are a number of non-trivial limitations associated with such current sharing techniques. For example, LED lighting devices are often restricted to operate from low voltage DC power supplies that are considered safe from the perspective of human shock hazard and/or fire safety. Such a limitation effectively restricts the number of LEDs that can be operated in series owing to the voltage drop per LED (e.g., ~3V per LED). If more LEDs are required to fulfill a given luminous requirement of the application, and only a single power supply is desired, it is necessary to operate parallel strings of series connected LEDs. This mode of operation can lead to inequalities in the current levels flowing through the parallel strings if the total forward voltages of the strings are not exactly equal. Moreover, the negative slope of the LED voltage versus temperature characteristic can create a runaway condition whereby the string with the highest current heats up more, further lowering its voltage, and further increasing its current versus the other strings. Such a runaway condition can be partially prevented by maintaining good thermal contact between the LED strings. However, such contact is not always possible or convenient owing to application requirements. To balance the string currents, some form of ballasting component may be employed. The simplest ballast is a resistor placed in series with each LED string. The voltage across the resistor increases sufficiently when the current increases to minimize variations in the string voltages and diminish the differences between the string currents. Larger resistor values better balance the currents. On the other hand, larger resistor values result in greater power dissipation which negatively impacts system efficacy. In this sense, the choice of the ballasting resistor value is a compromise between power loss and tolerance to current variation, which may be unacceptable.

Thus, and in accordance with an embodiment of the present invention, a current sharing circuit is configured to provide a ballasting function for LED lighting applications. The circuit is better able to balance the currents even when significant voltage differences exist between the strings. Furthermore, in some embodiments, the voltage drop across the ballasting circuit, and the consequent power loss, are minimized or otherwise reduced, relative to conventional ballasting techniques and circuits. In one such embodiment, each string is configured with or otherwise operatively coupled to a series-pass sub-circuit and a current sense sub-circuit for sensing current of that string. A monitor and control sub-circuit operates in conjunction with the series-pass sub-circuit to maintain the sensed current equal to a common reference level, wherein the common reference level is controlled to maintain the lowest series-pass element voltage close to or equal to zero volts. Numerous configurations will be apparent in light of this disclosure.

Circuit Architecture

FIG. 1 illustrates a block diagram of an LED device having a current sharing circuit configured in accordance with an embodiment of the present invention. As can be seen, the device includes a current sharing circuit operatively coupled between a plurality of parallel LED strings (string 1 through N) and an LED power supply. The current sharing circuit includes a string circuit (SC) for each string, with each string circuit comprising a series-pass circuit (SPC) and a current sense circuit (CSC). The string circuits are operatively coupled together, and to a string monitor and control circuit. Each of the series-pass, current sense, and string monitor and control circuits can be implemented with a number of configurations, as will be appreciated in light of this disclosure, such as in accordance with the example embodiments shown in FIGS. 2-10.

In operation, each series-pass circuit controls the current flowing through the corresponding LED string, and the corresponding current sense circuit senses current of that string. If the series-pass circuit passes excessive current, the corresponding current sense circuit will develop a higher voltage drop, thus lowering the drive voltage of the series-pass circuit which will in turn reduce the current passed by the series-pass circuit. The series-pass circuit can be implemented, for example, with a transistor (e.g., MOSFET or BJT) or two serially connected transistors (MOSFETs, BJTs, or combination of MOSFET and BJT) and the current sense circuit can be implemented with, for example, a resistor or resistor network. Numerous variations will be apparent in light of this disclosure, and the series-pass and current sense circuits can be implemented with any suitable componentry or circuitry capable of providing a comparable function as described herein.

The string monitor and control circuit operates in conjunction with the series-pass circuit to maintain the sensed current equal to a common reference level. The common reference level is controlled to maintain the lowest series-pass element voltage close to or equal to zero volts, in accordance with some embodiments. In one such case, the string monitor and control circuit is configured to null or otherwise substantially reduce the voltage across the transistor that controls the highest voltage string, which can be achieved, for example, by balancing diode and/or transistor voltage drops. For instance, a plurality of PN junction based semiconductor devices can be operatively coupled across that series-pass sub-circuit, wherein one or more of the PN junctions have a first polarity and the other PN junctions have an opposite polarity, such that the total voltage drop through the collective PN junction device is about zero volts (e.g., −0.25 VDC to +0.25 VDC, or better, such as −0.1 VDC to +0.1 VDC). Numerous such configurations will be apparent in light of this disclosure.

Example Implementations

Figure 2:
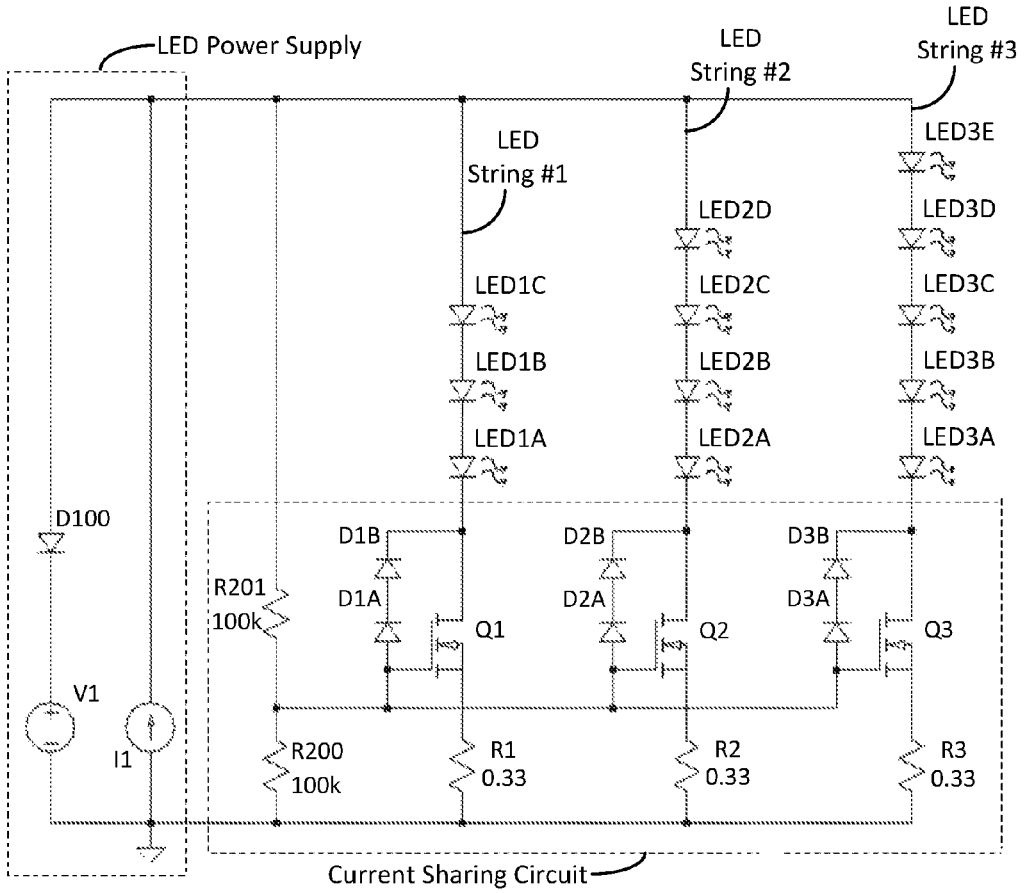
FIG. 2 schematically illustrates an LED device having a current sharing circuit configured in accordance with an embodiment of the present invention.
Figure 3:
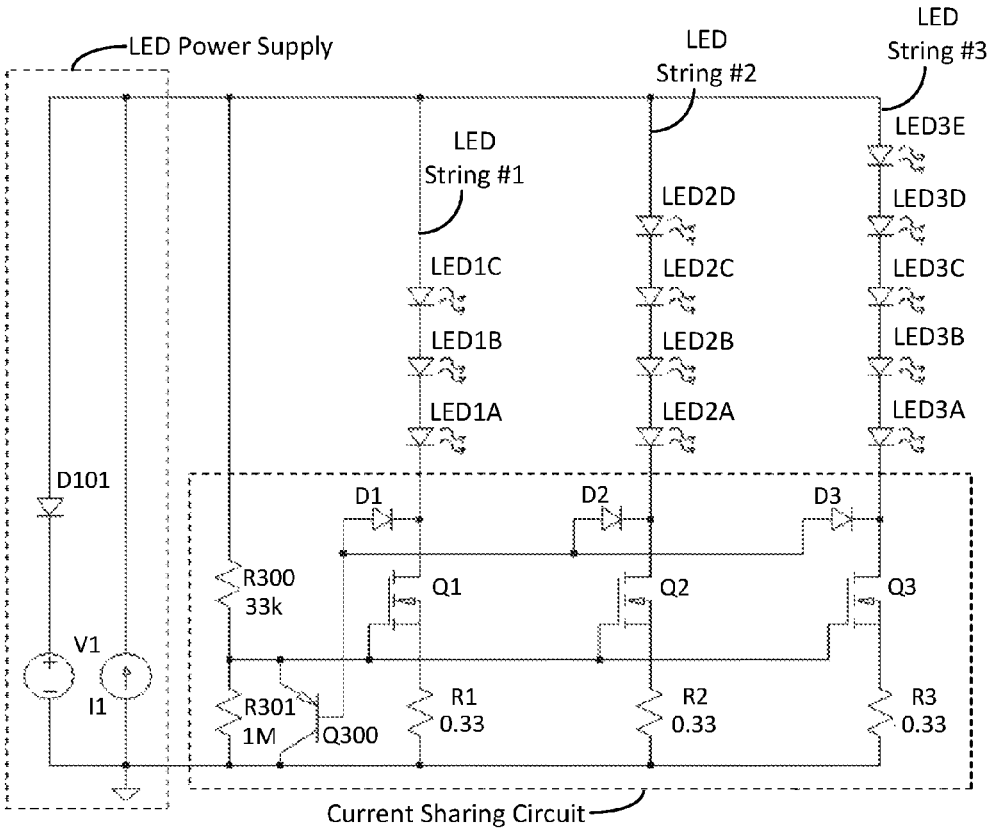
FIG. 3 schematically illustrates an LED device having a current sharing circuit configured in accordance with another embodiment of the present invention.
Figure 8:
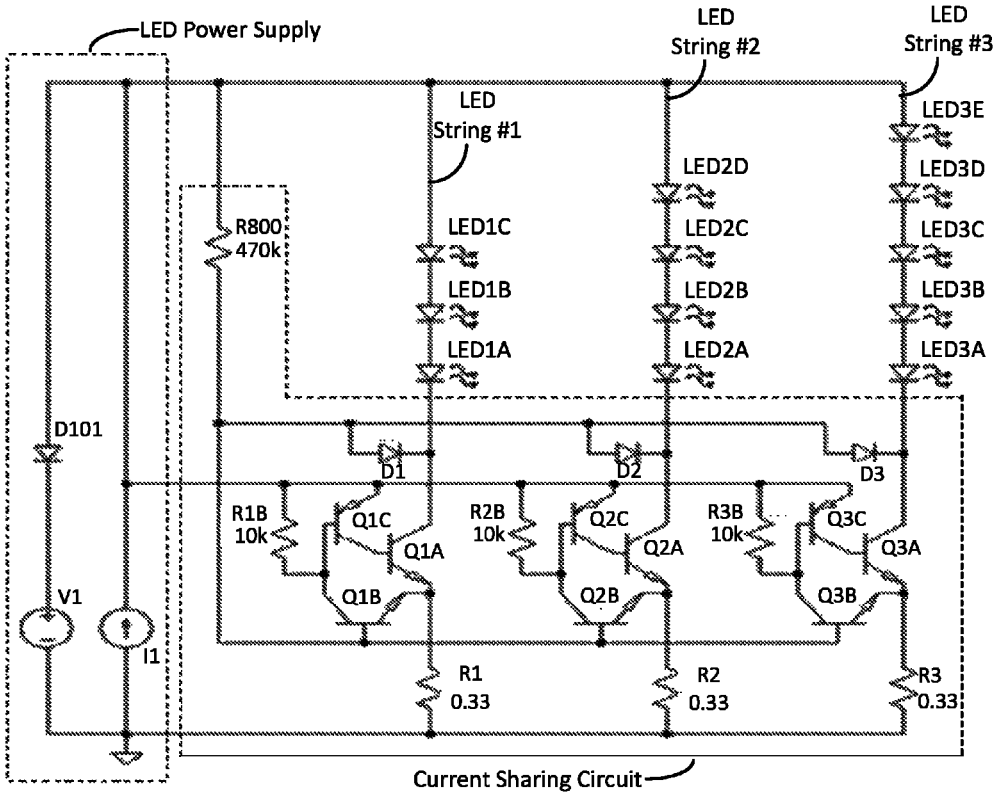
FIG. 8 schematically illustrates an LED device having a current sharing circuit configured in accordance with another embodiment of the present invention.
Figure 9:
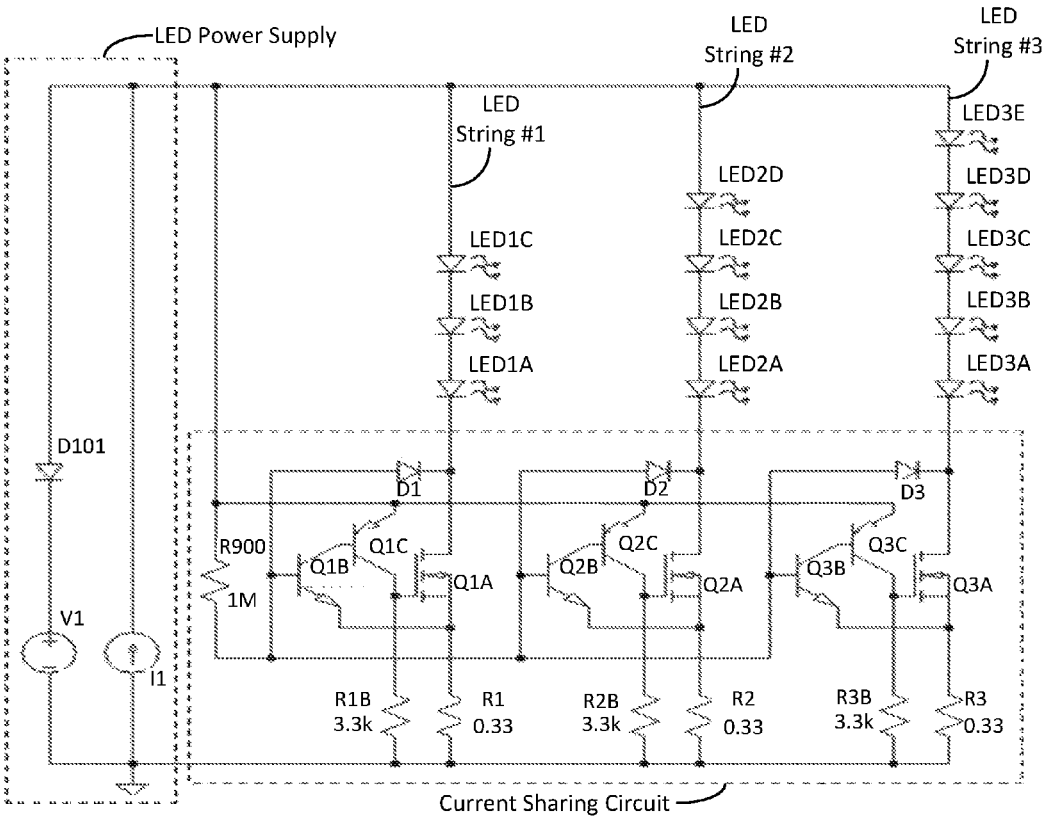
FIG. 9 schematically illustrates an LED device having a current sharing circuit configured in accordance with another embodiment of the present invention.
Figure 10:
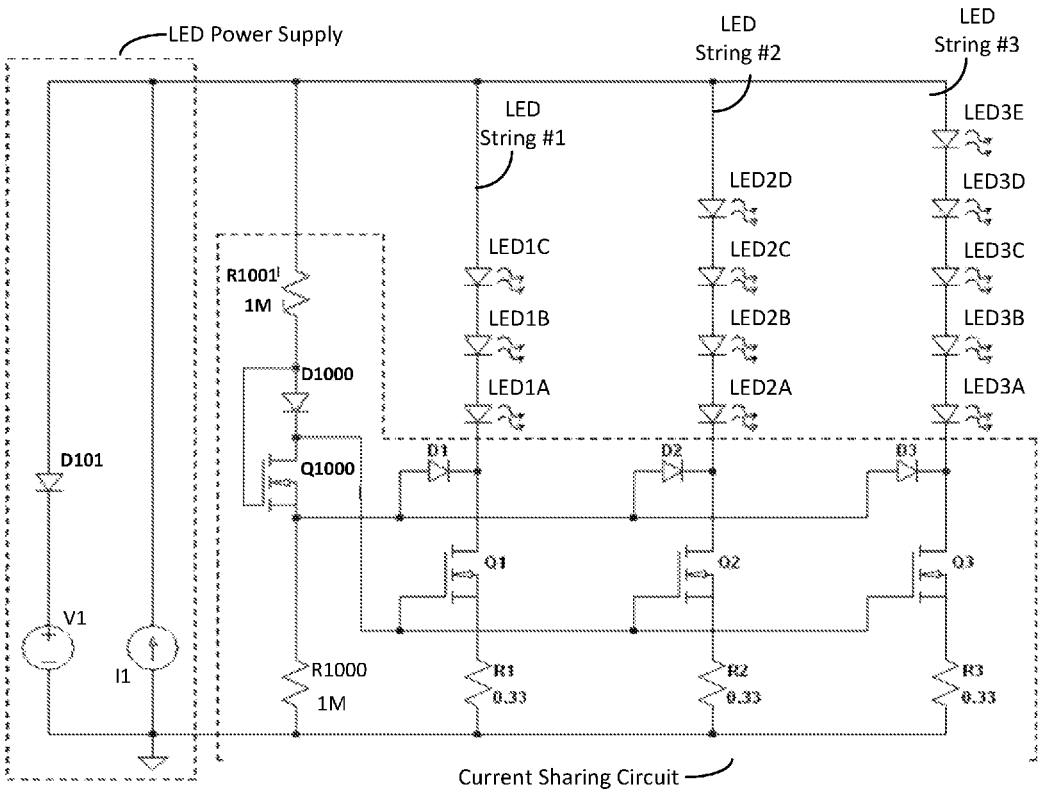
FIG. 10 schematically illustrates an LED device having a current sharing circuit configured in accordance with another embodiment of the present invention.

Nine specific example embodiments are provided in FIGS. 2-10, respectively. Note that the embodiment of FIG. 2 is sometimes referred to herein as embodiment #1, and embodiment of FIG. 3 is sometimes referred to herein as embodiment #2, etc, and embodiment of FIG. 10 is sometimes referred to herein as embodiment #9. Numerous equivalent designs and deviations and alternative configurations will be apparent in light of these example embodiments.

FIG. 2 schematically illustrates an LED device having a current sharing circuit configured in accordance with an embodiment of the present invention. As can be seen, the device includes an LED power supply, which in this example case is represented by current source I1, voltage source V1, and diode D100, which effectively provide a current source with a maximum voltage set by V1. As will be appreciated, the power supply may be configured with an AC-DC converter, such as one that converts 120 VAC to 42 VDC, or to some other appropriate DC power level suitable for a given lighting application. Any number of power supply configurations can be used, and the claimed invention is not intended to be limited to any particular one. In a more general sense, any power supply that is able to provide the necessary voltage and current to the LED strings for proper lighting operation for a given lighting application can be used. Further note that the power supply output may exceed the total voltage necessary to drive the LED strings to their full output potential, or may be intentionally selected to provide an output that under-drives the LED strings (or a subset of the strings), so as to extend lifespan as sometime done.

Three LED strings are shown in this example embodiment, but other embodiments may have fewer or more strings, as desired. As can be seen, the strings of this example have different numbers of LEDs to model a fairly extreme voltage difference between the strings. In reality, the strings would likely have an equal number of LEDs per string, but such string equality is not necessary. In addition, and as previously indicated, parallel LED strings ideally have closely matched forward voltages to have similar string currents, so as to therefore provide similar light output. However, variations in the manufacturing process effectively limit the sameness of one LED to the next LED, to some extent. In any case, a current sharing circuit configured in accordance with an embodiment of the present invention can be used to mitigate or otherwise neutralize such string current inequalities. Any number of LED types can be used, depending on factors such as the desired LED forward voltage drop and light color and intensity, as well as particulars of the given lighting application (e.g., office lighting versus surgical room lighting, etc). The forward voltage drop of the LEDs may be, for example, in the range of 1.5 VDC to 3.5 VDC, and in one specific example case is about 3 VDC. In a more general sense, any LED type can be used.

The current sharing circuit operates to balance or otherwise control the string currents to be within a given tolerance (e.g., such that all strings exhibit a current within +/−10%, or +/−5%, +/−2%, or +/−1% of one another). Each string of this example embodiment is controlled by one metal oxide semiconductor field effect transistor (MOSFET), one resistor, and two diodes. In particular: LED string #1 is controlled by MOSFET Q1, diodes INA and D1B, and resistor R1; LED string #2 is controlled by MOSFET Q2, diodes D2A and D2B, and resistor R2; and LED string #3 is controlled by MOSFET Q3, diodes D3A and D3B, and resistor R3. As will be appreciated in light of this disclosure, additional LED strings can be added by replicating this sub-circuit of the current sharing circuit, so long as the given power supply can sufficiently drive those strings.

In this example configuration, the gates of the MOSFETs Q1 through Q3 are connected together. In addition, the drain of each MOSFET is connected to the cathode end of an LED string, and the source of each MOSFET is connected to the negative return of the power supply through a small value resistor, R1 through R3. Initially, the resistors R1 through R3 can be ignored, as they are assumed to be a short, but may further serve to assist in balancing the string currents as will be discussed in turn, in accordance with some such embodiments. As can be further seen in this example case, the gate-source voltages of the MOSFETs are equal. In general, a MOSFET controls the current that passes from drain to source in response to its gate-source voltage. When the drain-source voltage exceeds a certain level, the drain-source current is practically independent of the drain-source voltage. Thus, assuming the MOSFETs Q1 through Q3 are well matched, meaning that their electronic properties are nearly identical or otherwise within a suitable tolerance, equal gate-source voltages result in nearly identical drain currents in the MOSFETs, and therefore nearly equal LED string currents. In this sense, the MOSFETs Q1 through Q3 effectively control the current in each of LED string #1 through string #3, respectively.

However, note that these three string currents must add up to the total current from the power supply. This is accomplished as follows. Resistor R201 provides a connection from the MOSFET gates to the positive supply to turn on the MOSFETs Q1 through Q3, and has a value of 100 kΩ in this example embodiment (other suitable resistor values or resistive networks can be used as well, so long as the desired circuit function as described herein can be achieved). The gate voltage is limited, however, by two diodes in series, connected between the gate and drain of each MOSFET as shown. This limits the gate voltage to approximately 1.4 VDC higher than the lowest of the drain voltages, assuming silicon diodes which generally have a forward voltage drop of about 0.7 VDC each. Further assume that, for purposes of this specific example, the gate-source turn-on voltage for the chosen MOSFETs Q1 through Q3 is about 1.5 VDC, so the result is a drain-source voltage of about 0.1 VDC on the MOSFET attached to the LED string with the highest forward voltage drop. For the example circuit shown in FIG. 2, this happens to be MOSFET Q3. If the power supply current were to exceed the sum of the three string currents, the drain voltage on MOSFET Q3 would rise. This would allow the gate voltage of MOSFET Q3 to rise, and the MOSFETs Q1 through Q3 would all become more conducting. Thus, the connection through the series diodes (D1A and D1B for string #1, D2A and D2B for string #2, and D3A and D3B for string #3) provides the negative feedback required to keep the sum of the LED string currents equal to the power supply current. By making the double diode voltage drop nearly equal to the MOSFET gate-source turn-on voltage, the voltage drops across the MOSFETs Q1 through Q3, and resultant power loss, are minimized. The near equality between the double diode voltage drop and the MOSFET gate-source turn-on voltage can be reflected, for instance, as a percentage difference between the two values, such as 10% or less, or 7.5% or less, or 5% or less, or 2.5% or less, or 1% or less, in accordance with some example embodiments. Assuming a double diode drop of about 1.4 VDC and a gate-source turn-on voltage of about 1.5 VDC, this percentage difference (or near equality) is about 6.7% (i.e., [1.5−1.4]/1.5*100%).

In some cases, the gate-source turn-on voltage of a MOSFET can be influenced by temperature, wherein higher temperature results in a lower turn-on voltage. For this reason, the MOSFETs Q1 through Q3 can be thermally connected to each other, in accordance with some embodiments. Otherwise, temperature differences between the MOSFETs Q1 through Q3 may imbalance the string currents. Note that the LED strings themselves need not be thermally connected to each other.

Resistor R200 of this example embodiment can be used to prevent voltage transients from destroying/damaging the gate connections when the current sharing circuit is not connected to the power supply or LED strings. This optional resistance is set to 100 kΩ in this example, but other suitably high resistance values can be used. The current sense resistors R1, R2, and R3 connect the sources of MOSFETs Q1 through Q3 to ground, compensating for differences between the MOSFETs and better balancing the string currents. If any MOSFET Q1 through Q3 passes excessive current, the corresponding sense resistor will develop a higher voltage drop, thus lowering the gate-source voltage of the MOSFET which will reduce the drain-source current. The resistance values or R1 through R3 are chosen as a compromise between control precision and power dissipation. Higher resistance values offer more precise current balance but dissipate more power. The value for each of the resistors R1 through R3 in this example case is 0.33Ω, but other suitable sense resistor values can be used as well, as will be appreciated in light of this disclosure. By using the techniques provided herein, smaller resistor values for R1 through R3 can be used relative to the necessary resistor that would have been necessary with a typical resistor ballasting scheme alone. As such, such embodiments of the present invention can be used to lower power dissipation.

Figure 2A:
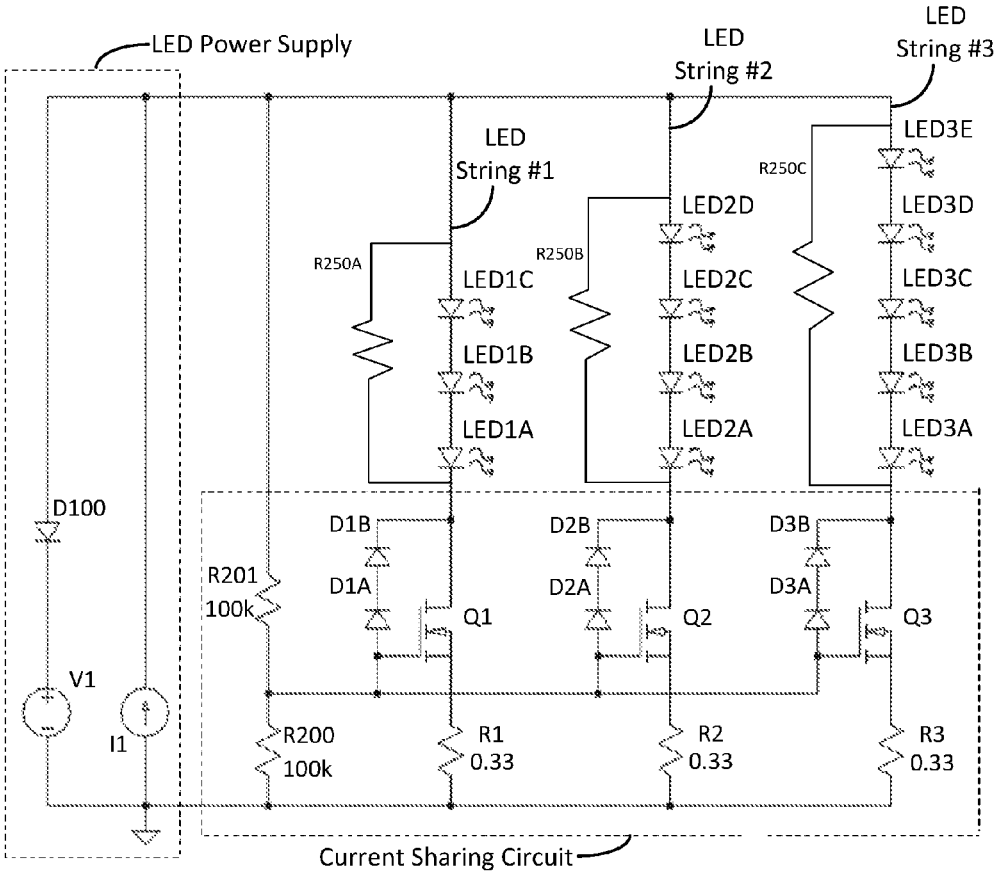
FIG. 2*a* schematically illustrates an LED device having a current sharing circuit configured in accordance with an embodiment of the present invention.

In this example configuration, if any of the LED strings fail open, the drain voltage of the attached MOSFET will collapse to zero, bringing the gate voltage down with it via the two diodes and shutting-off all of the MOSFETs Q1 through Q3. This means that an open failure in any of the LEDs in the strings will effectively shut down all of the LEDs and the circuit will appear nearly open to the power supply. In some case, the remaining LEDs may pass small (e.g., microampere) current levels which may enable some of them to dimly glow. If this failure condition is unacceptable, a large value resistor connected in parallel with each string (e.g., resistors 250A-250C illustrated in FIG. 2*a*) can ensure that the no light is produced at all upon the failure of any LED, in accordance with some embodiments.

As previously explained, the currents through the strings do not have to be held equal. Using different value current sense resistors (R1 through R3) in some or all of the strings results in current levels roughly proportional to the inverse of the resistance. If, for example, each string consists of different colored LEDs, the ability to control the ratios of string currents could be used to tune and maintain the color of a lighting product, in accordance with some embodiments. For the example embodiment shown in FIG. 2, the proportionality is quite rough, and the ratios of currents between the three depicted strings might vary depending on total power supply current. Some of the alternative embodiments that will be discussed in turn maintain more precise proportionality and more constant current ratios between strings as power supply current varies, if such is desired for a given application.

Disconnecting any current sense resistor R1 through R3 shuts off its associated LED string, leaving the remaining strings operating and dividing the current equally. Such a feature can be used, for example, to eliminate an unwanted string position from an already constructed circuit with more transistors than needed. Thus, some embodiments may include a switch in series with any of the current sense resistors R1 through R3 to pulse-width-modulate (PWM) the current through the associated string, or to simply allow for a given string to be taken out of the circuit. Conversely, a switch placed in parallel with any current sense resistor R1 through R3 can be used to shut off all other strings when the switch is closed, in accordance with some embodiments. In this case, full power supply current would be delivered solely to the one operating string.

The current sharing circuit can be constructed, for instance, from discrete components or built as an integrated circuit using any suitable manufacturing techniques. If built as an integrated circuit, it may be desirable to leave the current sense resistors R1 through R3 as discrete components so that the user has the option of varying the current or shutting off unused transistors. The integrated circuit approach offers various advantages including, for example, small parts count, tight matching of transistor properties, and close thermal contact between the transistors. In any case, the various components may be implemented with any available process technology and/or off-the-shelf parts, and the claimed invention is not intended to be limited to any particular set of component types or process technology, as will be appreciated in light of this disclosure.

FIG. 2 illustrates one particular example embodiment of the present invention; however, it may not provide the performance required for all applications. As such, several alternative embodiments are provided herein, so as to give rise to a broad array of performance attributes and applications. As will be seen, the various embodiments differ in the types of transistors (e.g., MOSFET or BJT) employed as the main current carrying component, the complexity of the gate or base drive sub-circuit, and the number of components used per LED string sub-circuit. The various properties of the demonstrated embodiments will be discussed with reference to FIGS. 11-13.

FIG. 3 schematically illustrates an LED device having a current sharing circuit configured in accordance with another embodiment of the present invention. This example embodiment also uses a single MOSFET to control each LED string current (MOSFET Q1 controls LED string #1 current; MOSFET Q2 controls LED string #2 current; and MOSFET Q3 controls LED string #3 current). This embodiment is similar to the example embodiment shown in FIG. 2, and the previous relevant discussion is equally applicable here. However, this example embodiment shown in FIG. 3 includes a bipolar junction transistor (BJT) Q300 to control the gate voltages of MOSFETS Q1 through Q3. Such a configuration allows for lower currents in the drain sense diodes D1 to D3 and may provide more accurate current control. As can be further seen, this example embodiment employs only a single diode (D1, D2, and D3) in each string control sub-circuit instead of the two diodes shown in the embodiment of FIG. 2 (D1A-B, D2A-B, and D3A-B). Resistor R300 provides a connection from the MOSFET gates to the positive supply to turn on the MOSFETs Q1 through Q3, and has a value of 33 kΩ in this example embodiment (other suitable resistor values or resistive networks can be used as well, so long as the desired circuit function as described herein can be achieved, as will be appreciated in light of this disclosure). Resistor R301 of this example embodiment can be used to prevent voltage transients as previously described, and also can be used to set the emitter bias of Q300. This optional resistance is set to 1 MΩ in this example, but other suitably high resistance values can be used as will be appreciated.

Figure 4:
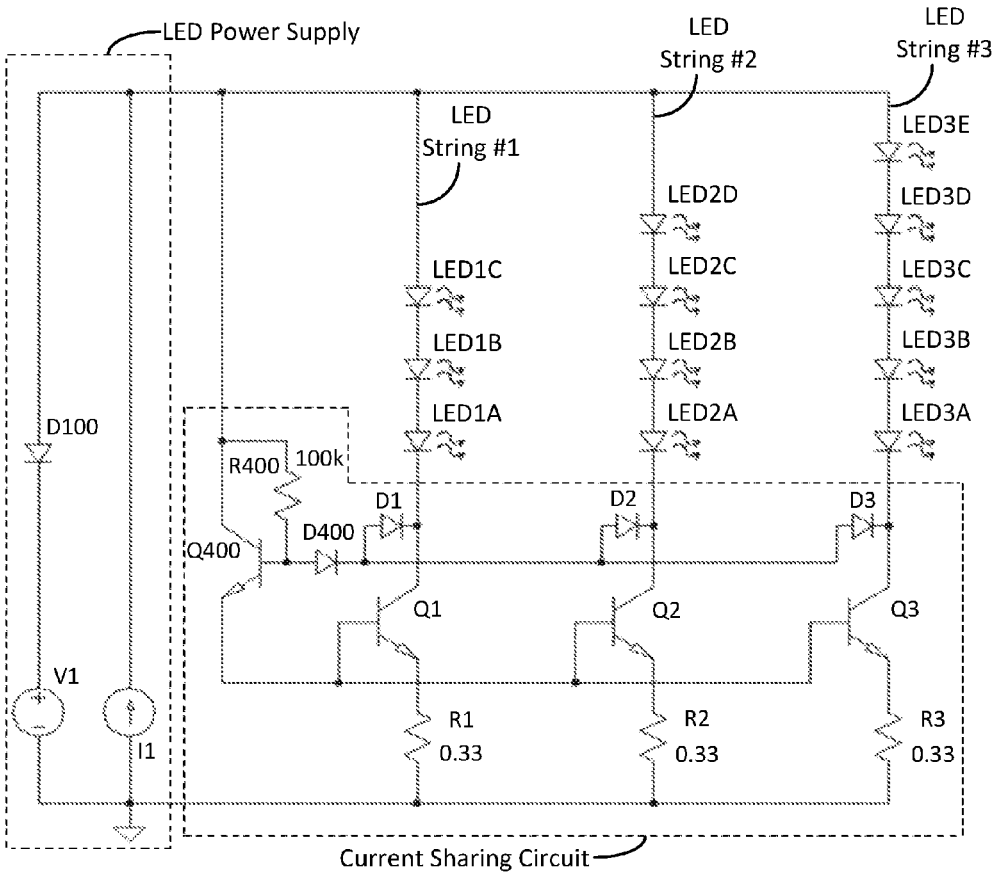
FIG. 4 schematically illustrates an LED device having a current sharing circuit configured in accordance with another embodiment of the present invention.

FIG. 4 schematically illustrates an LED device having a current sharing circuit configured in accordance with another embodiment of the present invention. As can be seen in this example case, a single BJT is used to control each LED string current (BJT Q1 controls LED string #1 current; BJT Q2 controls LED string #2 current; and BJT Q3 controls LED string #3 current). In general, the base turn-on voltage of a BJT transistor has a tighter tolerance than the gate turn-on voltage of a MOSFET. This tighter turn-on tolerance may result in more precise current balance between the strings, if so desired for a given lighting application. The collector-emitter current of a BJT is influenced by the collector-emitter voltage, however, which will allow differences in string voltages to affect the currents. Resistor R400 provides a connection from the positive supply to the biasing node between BJT Q400 and diode D400, and has a value of 100 kΩ in this example embodiment (other suitable resistor values or resistive networks can be used as well, so long as the desired circuit function as described herein can be achieved, as will be appreciated in light of this disclosure).

As with MOSFETs, the base-emitter turn-on voltage decreases as temperature increases. This voltage is similar to the forward voltage drop across a diode. For this reason, the path from the collector of BJT Q3, through diode D3, diode D400, and the base-emitter junctions of BJTs Q400 and Q3 should result in near zero collector-emitter voltage across Q3, regardless of temperature. In particular, diodes D3 and D400 each provide a voltage drop of about 0.7 VDC which effectively cancel the 0.7 VDC voltage drops of opposite polarity across each of the base-emitter junctions of BJTs Q400 and Q3, assuming silicon junctions for each of the diodes (D1 through D3 and D400) and for each of the BJTs (Q1 through Q3 and Q400). Thus, nulling the voltage across the transistor that controls the highest voltage string can be achieved by balancing diode and transistor voltage drops.

Figure 5:
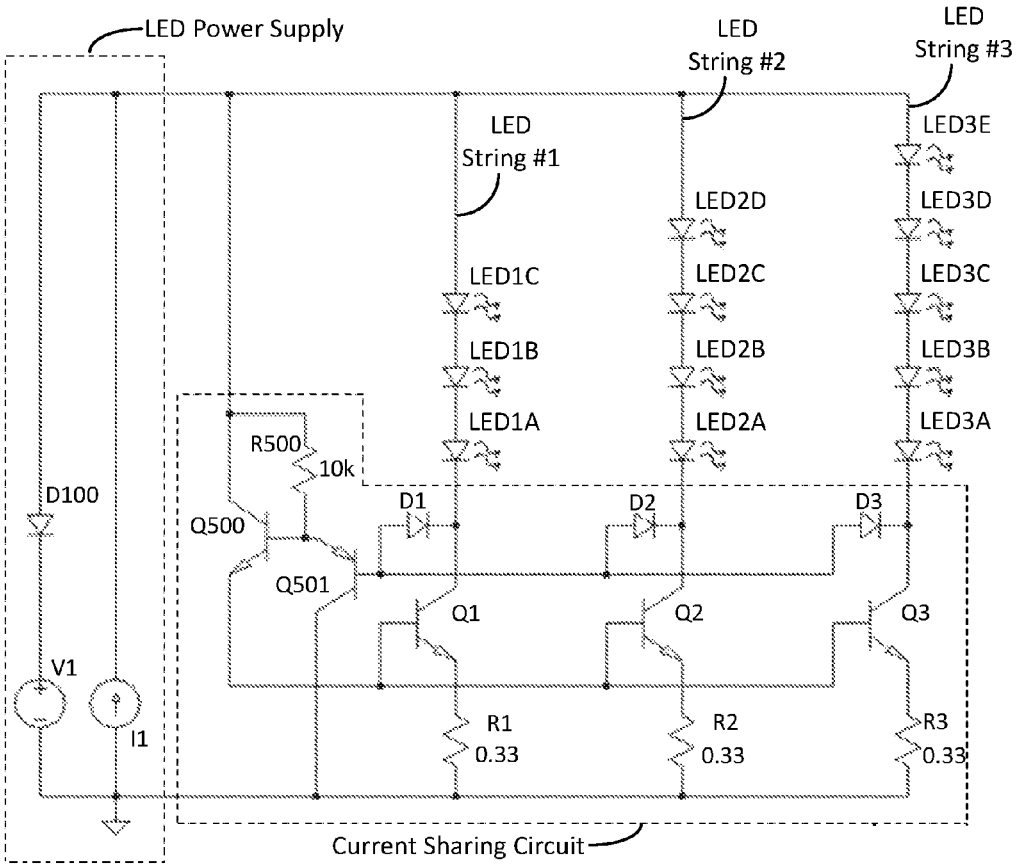
FIG. 5 schematically illustrates an LED device having a current sharing circuit configured in accordance with another embodiment of the present invention.

FIG. 5 schematically illustrates an LED device having a current sharing circuit configured in accordance with another embodiment of the present invention. As with the example embodiment of FIG. 4, a single BJT transistor is used to control each LED string current (BJT Q1 controls LED string #1 current; BJT Q2 controls LED string #2 current; and BJT Q3 controls LED string #3 current). This embodiment of FIG. 5 differs from the embodiment of FIG. 4, in that a PNP BJT transistor Q501 has replaced diode D400, and resistor R500 has one-tenth the value of R400. This change allows the currents through the collector sense diodes D1 to D3 to be lower while allowing for larger currents through Q500 and the bases of BJTs Q1, Q2, and Q3. Such an embodiment may be used to provide an improvement in current balance precision and lower power dissipation in the string control transistors (Q1 through Q3). Note that substantially nulling the voltage across the transistor that controls the highest voltage string is again achieved by balancing diode and transistor voltage drops. In this particular embodiment, diode D3 and the base-emitter junction of PNP BJT Q501 each provide a voltage drop of about 0.7 VDC which effectively cancel the 0.7 VDC voltage drops of opposite polarity across each of the base-emitter junctions of NPN BJTs Q500 and Q3, assuming silicon junctions for each of the diodes (D1 through D3) and for each of the BJTs (Q1 through Q3, Q500, and Q501).

Figure 6:
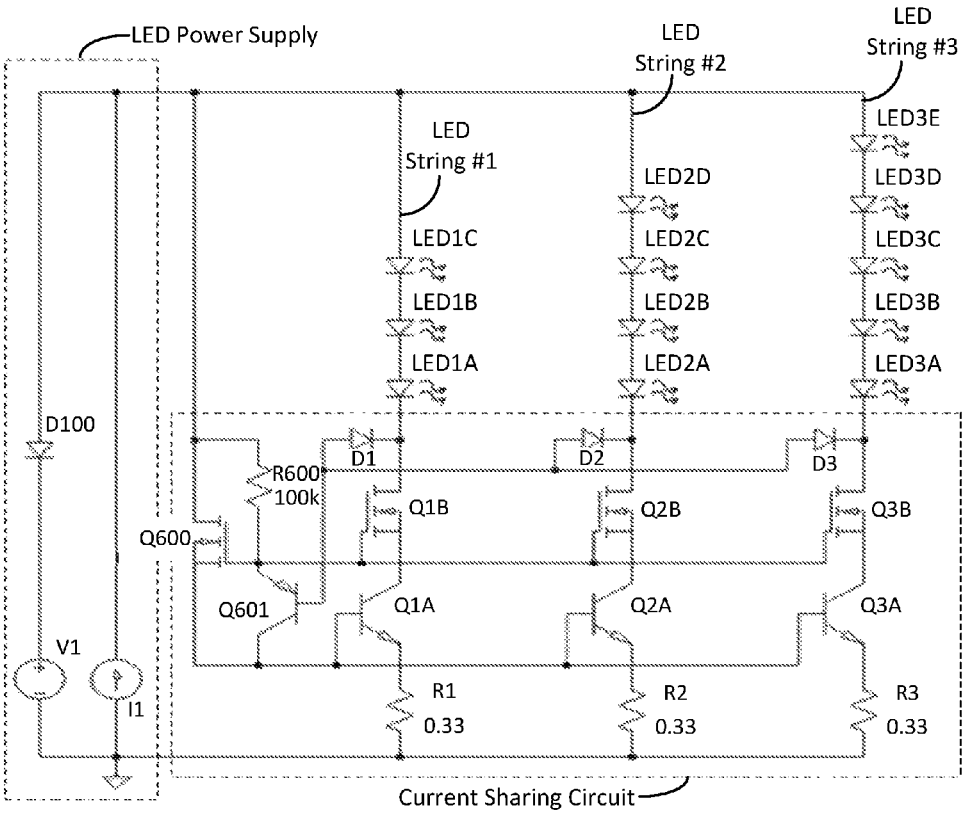
FIG. 6 schematically illustrates an LED device having a current sharing circuit configured in accordance with another embodiment of the present invention.

FIG. 6 schematically illustrates an LED device having a current sharing circuit configured in accordance with another embodiment of the present invention. In this example case, a BJT and MOSFET in cascode configuration are used to control each LED string current (BJT Q1A and MOSFET Q1B control LED string #1 current; BJT Q2A and MOSFET Q2B control LED string #2 current; and BJT Q3A and MOSFET Q3B control LED string #3 current). Since the collector-emitter current of a BJT transistor is not entirely independent of the collector-emitter voltage, a MOSFET transistor (Q1B, Q2B and Q3B) is placed in the collector circuit of each string control BJT (Q1A, Q2A, and Q3A, respectively) to reduce the variation of the collector voltage. Resistor R600 provides a connection from the positive supply to the biasing node between MOSFET Q600 and BJT Q601, and has a value of 100 kΩ in this example embodiment (other suitable resistor values or resistive networks can be used as well, so long as the desired circuit function as described herein can be achieved, as will be appreciated in light of this disclosure). In this example control sub-circuit, Q600 is a MOSFET, so that its gate voltage can provide a suitable bias voltage reference point for control of the gates of the cascode MOSFETs Q1B, Q2B and Q3B.

As will be appreciated, this embodiment also attempts to minimize or otherwise reduce the voltage across the string current control transistors, but owing to the mix of BJTs Q1A, Q2A, and Q3A and MOSFETs Q1B, Q2B and Q3B, and the fact that there is a series combination of transistors performing current control for each string, there is a relatively large voltage drop across the transistors. On the other hand, such an embodiment also has very precise current control, which may be superior to current control provided by the previous embodiments of FIGS. 2-5.

Figure 7:
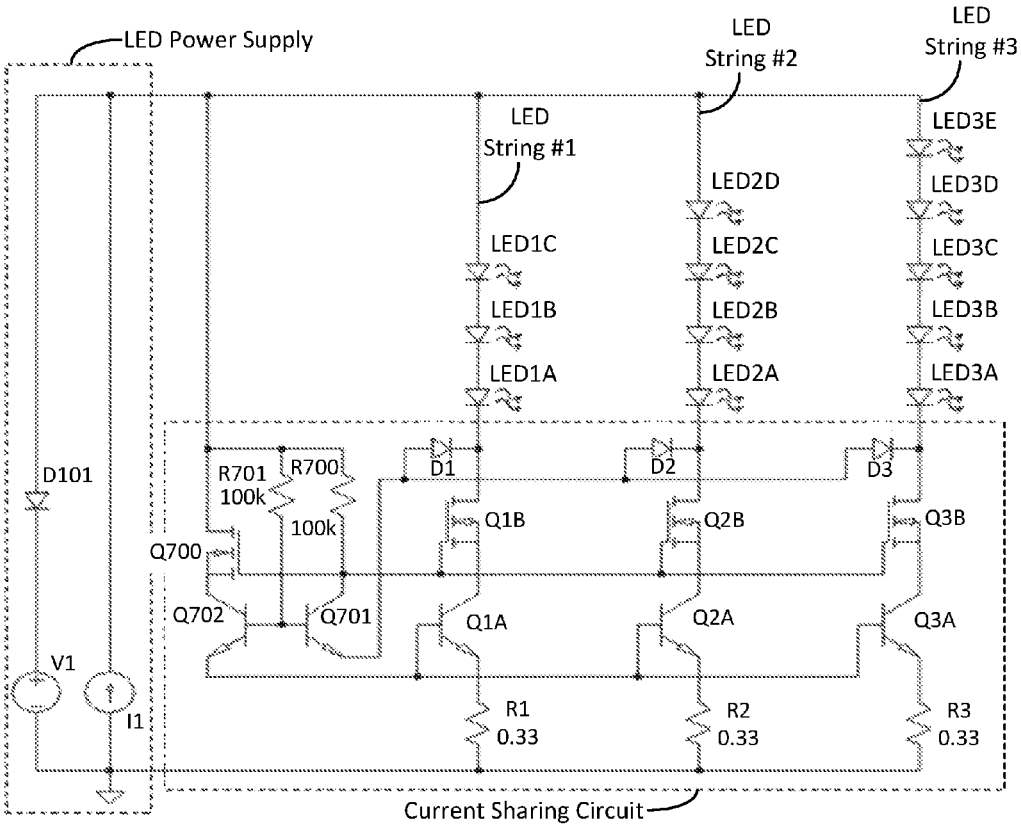
FIG. 7 schematically illustrates an LED device having a current sharing circuit configured in accordance with another embodiment of the present invention.

FIG. 7 schematically illustrates an LED device having a current sharing circuit configured in accordance with another embodiment of the present invention. This example case also employs a BJT and MOSFET in cascode configuration to control each LED string current (BJT Q1A and MOSFET Q1B control LED string #1 current; BJT Q2A and MOSFET Q2B control LED string #2 current; and BJT Q3A and MOSFET Q3B control LED string #3 current). The difference between this embodiment and the embodiment of FIG. 6 is with respect to the control sub-circuit. In particular, an additional NPN BJT Q702 has been added to MOSFET Q700 in cascode configuration, mimicking the string control configurations. BJT Q701 has been changed to an NPN type and its base is joined to the base of BJT Q702. Resistor R701 has been added to supply bias current to the bases of BJTs Q701 and Q702. These changes allow for improved nulling of the voltage across the circuit that controls the highest voltage string, which in this example case includes the series combination of Q3A and Q3B. In particular, the path from the drain of MOSFET Q3B, through diode D3 (e.g., +0.7 VDC), and the base-emitter junctions of BJTs Q601 (e.g., +0.7 VDC), Q602 (e.g., −0.7 VDC) and Q3A (e.g., −0.7 VDC) should result in near zero voltage from the drain of Q3B to the emitter of Q3A, in accordance with an embodiment of the present invention. Resistors R700 and R701 provide a connection from the positive supply to biasing nodes of BJTs Q701 and Q702, each having a value of 100 kΩ in this example embodiment (other suitable resistor values or resistive networks can be used as well, so long as the desired circuit function as described herein can be achieved, as will be appreciated in light of this disclosure).

FIG. 8 schematically illustrates an LED device having a current sharing circuit configured in accordance with another embodiment of the present invention. This example case also employs three BJT transistors to control each LED string current (BJTs Q1A, Q1B, and Q1C control LED string #1 current; BJTs Q2A, Q2B, and Q2C control LED string #2 current; and BJTs Q3A, Q3B, and Q3C control LED string #3 current). This example embodiment has a control sub-circuit that includes one resistor, R800, which has a resistance value of 470 kΩ (numerous other values can be used to provide suitable functionality as will be appreciated in light of this disclosure). The LED string current control sub-circuit for each of the three LED strings of this example embodiment each employs two NPN BJTs, one PNP BJT, a diode and two resistors. As will be appreciated in light of this disclosure, the added complexity obtains significant improvements in performance. As will be further appreciated in light of this disclosure, note that a single one of the transistors can be attributed to the LED string current control circuit, and the other two transistors, diode, and two resistors can be attributed to the control sub-circuit. In this sense, the various sub-circuit references herein are not intended to implicate rigid limitations on what components belong to what sub-circuit, as there may be overlap in some cases. In a more general sense, the overall functionality of the current sharing circuit may be divided into various sub-circuits which may vary from one embodiment to the next without substantially deviating from the spirit of the claimed invention, and it is intended that any such embodiments that provide functionality as explained herein fall within the scope of the claims.

In this more detail, the B-transistor of the string current control sub-circuit (Q1B, Q2B, Q3B) monitors the voltage at the top of the corresponding current sense resistor (R1, R2, R3). The collector-emitter voltages across these B-transistors and the collector-emitter currents through them are almost identical between the strings, so there is minimal error in sensing the current. The B-transistor collector currents flow through the corresponding B-resistors (R1B, R2B, R3B) until the voltage drop across the resistors reach about 0.6V, sufficient to turn on the C-transistors of the string current control sub-circuit (Q1C, Q2C, Q3C). At this point, the C-transistors are able to supply base current to the A-transistors (Q1A, Q2A, Q3A) of the string current control sub-circuit and turn them on so they can conduct LED current. The combined action of the B, C, and A transistors of the string current control sub-circuit provides high-gain negative feedback to stabilize the LED string current. The path from the collector of BJT Q3A, through diode D3 (e.g., +0.7 VDC), and the base-emitter junction of BJT Q3B (e.g., −0.7 VDC) should result in near zero collector-emitter voltage across Q3A. Note that, since diode D3 and BJT Q3B (or the corresponding components for whichever string has the highest LED forward voltage) alone set the output voltage, only these components need to be in thermal contact between the strings.

In such an embodiment, note that the electrical characteristics of the A-transistors, which handle the string current, have little effect on the current balancing accuracy or the power dissipation. In fact, the embodiment is so tolerant to the choice of A-transistors that the different strings can even use transistors with different specifications. For example, strings with higher currents, set by smaller current sense resistors, could use higher power A-transistors. Even N-channel MOSFET transistors could be used in the A-transistor role provided a suitably large value resistor were added from gate to source. As will be further appreciated in light of this disclosure, this embodiment especially lends itself to integration, to reduce parts count. As previously discussed, the current sense resistors could be left as discrete parts for more flexibility. Furthermore, the power transistors, Q1A, Q2A, and Q3A could be left as discrete parts allowing for flexibility in the choice of power handling capability and package type, as previously indicated.

FIG. 9 schematically illustrates an LED device having a current sharing circuit configured in accordance with another embodiment of the present invention. This example case also employs two BJT transistors and one MOSFET to control each LED string current (MOSFET Q1A, and BJTs Q1B and Q1C control LED string #1 current; MOSFET Q2A, and BJTs Q2B and Q2C control LED string #2 current; and MOSFET Q3A, and BJTs Q3B and Q3C control LED string #3 current). This embodiment is similar to the embodiment shown in FIG. 8, but with a MOSFET Q1A, Q2A, and Q3A instead of a BJT controlling the string current. A bias resistor (R1B, R2B, R3B) has also changed location to accommodate the change in transistor type, each of which has a resistance value of 3.3 kΩ in this example embodiment (but any suitable resistance value or network can be used to provide the functionality as described herein). This embodiment shares the benefits of embodiment #7 (FIG. 8), but simulation shows improved performance. The control sub-circuit of this example configuration includes one resistor, R900, which has a resistance value of 1 MΩ (numerous other values can be used to provide suitable functionality).

FIG. 10 schematically illustrates an LED device having a current sharing circuit configured in accordance with another embodiment of the present invention. This example case also employs a single MOSFET to control each LED string current (MOSFET Q1 controls LED string #1 current; MOSFET Q2 controls LED string #2 current; and MOSFET Q3 controls LED string #3 current). This embodiment is similar to the one shown in FIG. 3. The difference is in the gate control sub-circuit. In particular, MOSFET Q1000 and diode D1000, together with resistors R1000 and R1001, provide a well-controlled bias voltage for the gate control line. This embodiment carefully nulls the drain-source voltage drop across the transistor that controls the highest voltage string, which in this example case happens to be MOSFET Q3. The path from the drain of MOSFET Q3, through diode D3 (e.g., +0.7 VDC), through the source-gate drop of Q1000 (e.g., +1.5 VDC), through diode D1000 (e.g., −0.7 VDC), and through the gate-source drop of Q3 (e.g., −1.5 VDC), results in near zero drain-source voltage drop across Q3, in accordance with one example configuration.

As previously indicated, each of the embodiments can be implemented using any number of components and process technologies, and each of the embodiments have fast response times allowing them to function in pulse width modulated (PWM) systems where the LED power supply modulates the current. Many other alternative embodiments are possible, including the use of op-amp circuits and/or microcontrollers. Numerous variations and configurations will be apparent in light of this disclosure.

Thus, a current sharing circuit configured in accordance with an embodiment of the present invention generally includes a series-pass control component for current control of each string each LED string and a current sense component for sensing current of each LED string. The series-pass component is controlled to maintain the sensed current equal to a common reference level. A network of diodes or other such components monitors the voltage across the series-pass element having the lowest voltage, and the common reference level is controlled by a circuit that strives to maintain the lowest series-pass element voltage drop equal to or otherwise as close to zero volts (e.g., 0 VDC+/−0.25 VDC, or 0 VDC+/−0.2 VDC, or 0 VDC+/−0.15 VDC, or 0 VDC+/−0.1 VDC, or 0 VDC+/−0.075 VDC, or 0 VDC+/−0.05 VDC, or 0 VDC+/−0.025 VDC, or 0 VDC+/−0.02 VDC).

Further note that the disclosed embodiments make no assumption about which string has the highest voltage. In contrast, some conventional techniques rely on a given string to have the highest forward voltage. In such designs, it is not possible to design a system with nominally equal string voltages. This is a built-in inefficiency in the design since inequality between string voltages creates power loss in the associated ballasting or linear regulation component. Furthermore, if any other string has a higher forward voltage than that of the designated highest string, its transistor will begin to shut-off. At the point where any string voltage is greater than that of the designated highest string by more than a given turn-on voltage, current through that string will completely extinguish.

Performance Comparison

Figure 11:
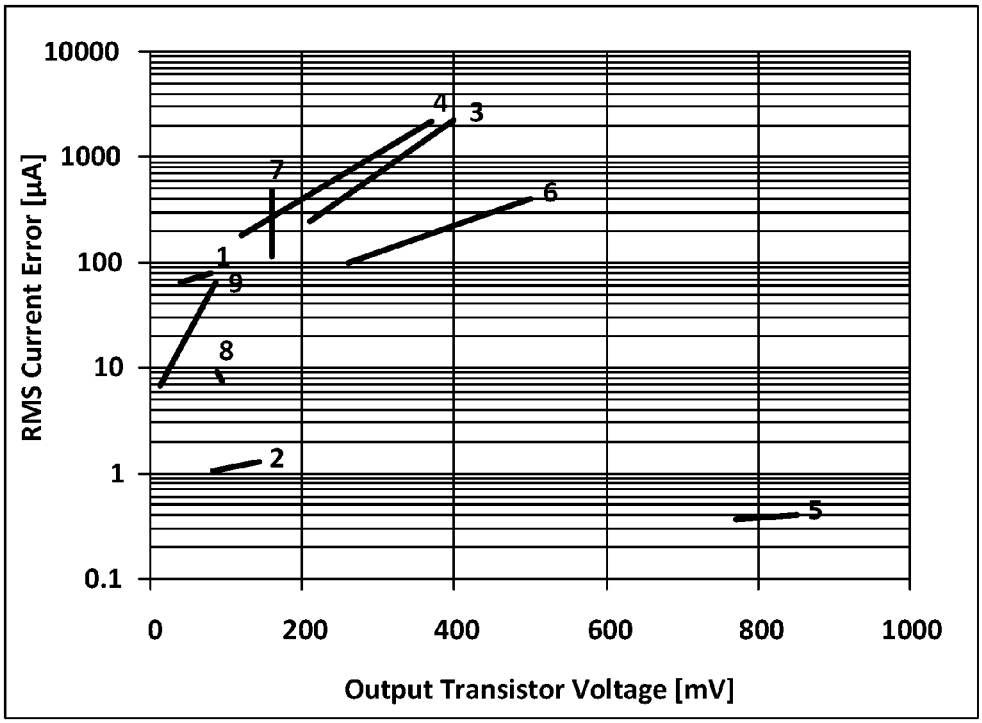
FIG. 11 graphically illustrates simulated performance characteristics of lighting devices configured in accordance with the example embodiments shown in FIGS. 2 through 10.
Figure 12:
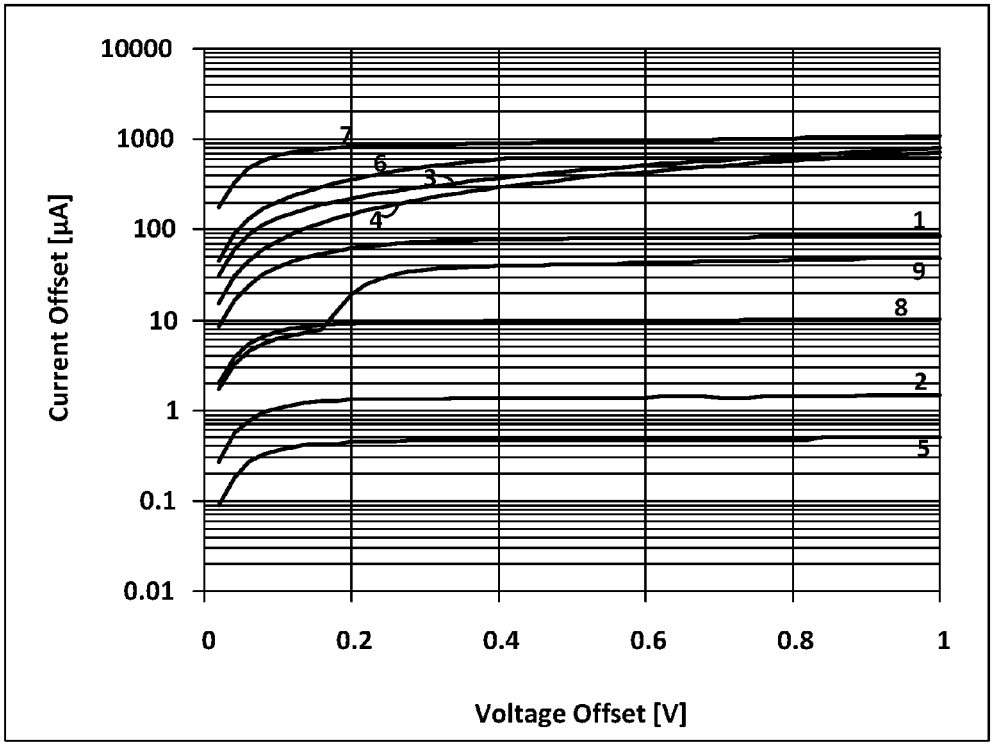
FIG. 12 is a plot of modeled current imbalance (or offset) as a function of voltage offset between the strings for each of the example embodiments shown in FIGS. 2 through 10.
Figure 13:
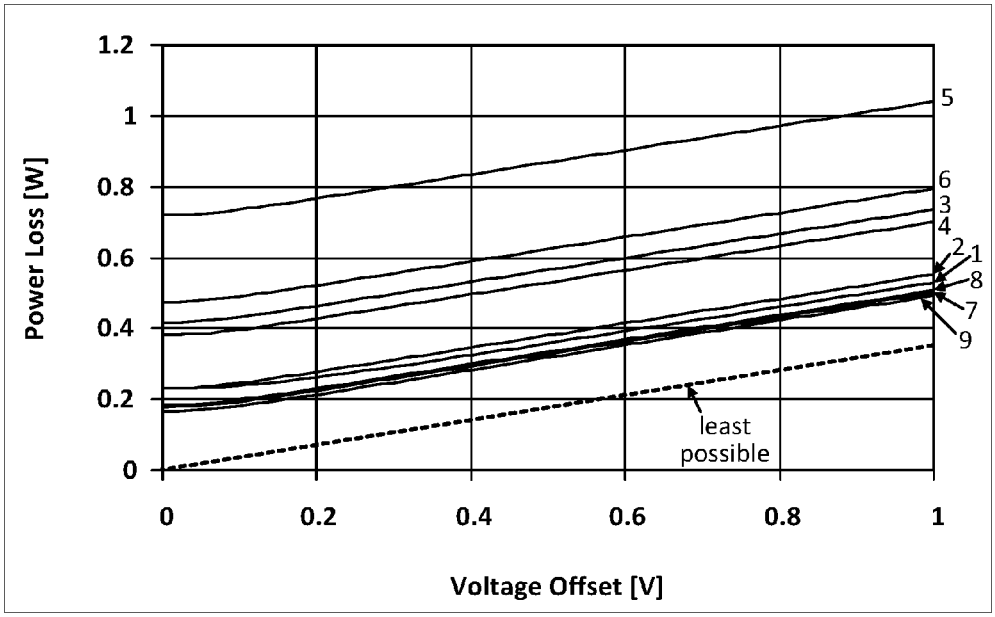
FIG. 13 is a plot of modeled power loss as a function of voltage offset between the strings for each of the example embodiments shown in FIGS. 2 through 10.

Simulated performance characteristics of the nine embodiments provided in FIGS. 2-10, respectively, are plotted in each of the graphs shown in FIGS. 11-13. Note that the plots in FIGS. 11-13 associated with the embodiment of FIG. 2 are designated with number 1, and the plots in FIGS. 11-13 associated with the embodiment of FIG. 3 are designated with number 2, etc, and the plots in FIGS. 11-13 associated with the embodiment of FIG. 10 are designated with number 9.

As can be seen with reference to the plots of FIG. 11, the vertical axis shows rms current imbalance between the example three strings. The horizontal axis shows the minimum voltage across the current control transistor (or transistors, for the embodiments of FIGS. 6 and 7). Note that the voltage drop across the current sense resistor is not included since it is consistent between the embodiments and can be readily calculated if so desired. The nine plots in FIG. 11 span the range from about 6.66 mA to 333 mA per string.

The best performance is at the lower left corner of the graph, indicating small current mismatch between the LED strings and low voltages across the transistors and therefore little power dissipation. From this perspective, the embodiment shown in FIG. 3 (plot 2) appears to be the best one; note, however, that these simulated results do not include parameter variations between the parts. Real implementations of these example embodiments could perform differently from the simulated results and therefore migrate horizontally and/or vertically on the graph in FIG. 11, as will be appreciated.

To further explore the performance of these various embodiments, a simulation was done for each in which only two strings of LEDs were attached, and a variable voltage offset between the strings was imposed. The total power supply current was fixed at 700 mA. FIG. 12 shows plots of the resultant modeled current imbalance as a function of the voltage offset between the strings. The voltage offset ranges from 0 to 1V. As in FIG. 11, each curve/plot on the graph of FIG. 12 is marked with its corresponding embodiment number (with embodiment #1 corresponding to FIG. 2, embodiment #2 corresponding to FIG. 3, . . . and embodiment #9 corresponding to FIG. 10). Note that even the highest current offset shown is only about 1 mA, or 0.29% of LED string current.

FIG. 13 shows the corresponding modeled power loss, as a function of the voltage offset between the strings. The conditions are the same as for the examples shown in FIG. 12. As can be seen, the curves for embodiment #s 7 and 8 (FIGS. 8 and 9, respectively) are just about indistinguishable (they lie on top of or otherwise very close to each other). The dashed line at the bottom of the plot shows the minimum power loss possible for a linear (series-pass) regulator making up a voltage offset with a string current of 350 mA (the value is the product of 350 mA times the voltage offset). Note that the most efficient embodiments come within less than 150 mW of the theoretical minimum at this current level.

Another difference between the various embodiments that is not evident from the plots is their robustness against component parameter variations owing to parts tolerances or thermal variations. Horizontal migration in FIG. 11 (corresponding to vertical migration in FIG. 13) is reduced when the path from drain (collector) to source (emitter) across the output transistor contains parts of the same type arranged such that their voltage drops cancel each other. This has been done in embodiment #s 3, 4, 6, 7, 8, and 9 (or the embodiments in FIGS. 4, 5, 6, 7, 8, 9, and 10, respectively).

Current offset can have several components. One is the effect of the non-zero current flowing through the drain (collector) voltage sense diodes. This current flows only into the one output transistor with the lowest drain (collector) voltage, adding to the current in that string's sense resistor but not to the LED string itself. The result is a decrease in the LED string current for the string with the highest forward voltage. This is a miniscule effect if the control sub-circuit requires little current from the voltage sense diodes. This current varies by more than a factor of 100 for the various example embodiments shown, with #s 1, 3 and 6 (FIGS. 2, 4, and 7) having the highest currents and #s 2 and 5 (FIGS. 3 and 6) having the lowest. This corresponds reasonably well with the trends in FIGS. 11 and 12. Embodiment #s 4, 7, 8, and 9 (FIGS. 5, 8, 9, and 10) have slightly higher voltage sense currents than embodiment #s 2 and 5 (FIGS. 3 and 6).

Another contribution to current offset can be the dependence of current on transistor drain-source (collector-emitter) voltage. This dependence is strongest at the lowest drain-source (collector-emitter) voltage which is the situation for the transistor controlling the string with the largest forward voltage. Without precautions, minimizing output transistor voltage drop therefore may compromise offset current. Embodiment #s 5, 6, 7 and 8 (FIGS. 6, 7, 8, and 9) include such precautions. Embodiment #s 5 and 6 (FIGS. 6 and 7) use cascode configurations to de-couple LED string voltage variations from the BJT controlling transistor. Embodiment #s 7 and 8 (FIGS. 8 and 9), implement a two-transistor amplifier at each string to feed current sense information back to the current control transistor. In these two embodiments, the two-transistor amplifier is placed between the common control line and the gates (bases) of the series-pass current control transistors. This property may make embodiment #s 7 and 8 more resilient than the others to parameter variations.

An embodiment similar to embodiment #1 (i.e., the embodiment shown in FIG. 2) was actually implemented. The constructed version had four parallel strings rather than three. Testing of the circuit was done using single power resistors in place of the LED strings. The results are shown in Table 1. The total power supply current was 1.95 A, resulting in an average current of 495 mA in each of the four strings. The voltage of the strings varied by 478 mV from highest to lowest. The currents in the four strings varied with a standard deviation of 4.6 mA or 0.93% of their average current. In this example test, the string with the highest load voltage had the highest current and visa-versa. Circuit simulations showed the opposite behavior from that seen in Table 1: current should be highest for the MOSFET with the highest drain-source voltage and highest gate-source voltage. A further effect should also push in the opposite direction from that seen in Table 1: the MOSFET with the highest drain-source voltage should dissipate the highest power, get hotter than the others, and decrease its gate-source turn-on voltage, thereby increasing the current.

TABLE 1

Experimental data from a test of circuit implementation of embodiment #1 with four strings. Resistor loads were used in place of LED strings.

| | | | | | |
|---|---|---|---|---|---|
| | 15.363 | | supply voltage [V] | | |
| | 1.980 | | supply current [A] | | |
| | 1.151 | | $V_{gate}$ [V] | | |
| string | $V_{load}$ [V] | current [A] | $V_{drain}$ [V] | $V_{gate\text{-}source}$ [V] | $V_{drain\text{-}source}$ [V] |
| 1 | 15.026 | 0.496 | 0.337 | 0.987 | 0.173 |
| 2 | 15.093 | 0.500 | 0.270 | 0.986 | 0.105 |
| 3 | 15.019 | 0.496 | 0.344 | 0.987 | 0.180 |
| 4 | 14.615 | 0.489 | 0.748 | 0.990 | 0.587 |
| | 0.495 | | mean current [A] | | |
| | 0.93% | | standard deviation | | |

Evidently, what the data in Table 1 are showing is variation in parameters, such as gate-source turn-on voltage, between the four MOSFETs. This variation is not evident in simulation calculations since all transistor parameters are identical there.

Numerous variations and embodiments will be apparent in light in this disclosure. For instance, one embodiment provides a current balancing circuit. The circuit includes a plurality of series-pass sub-circuits, each configured to control current flow through a corresponding LED string. The circuit further includes a plurality of current sense sub-circuits, each configured to sense current flowing through a corresponding LED string. The circuit further includes a string monitor and control sub-circuit configured to substantially null the voltage across the series-pass sub-circuit that controls a highest voltage LED string. In some cases, the voltage across the series-pass sub-circuit that controls the highest voltage LED string is nulled to be in the range of about −0.20 VDC to +0.20 VDC. In some cases, if current increases in one of the series-pass sub-circuits, the corresponding current sense sub-circuit is configured to develop a higher voltage drop thereby lowering drive voltage of that series-pass sub-circuit which in turn reduces current passed by that series-pass sub-circuit. In some cases, each series-pass sub-circuit comprises a transistor and each of those series-pass sub-circuit transistors has a gate/base that is connected to a common node that is further connected to the string monitor and control sub-circuit, and each of those series-pass sub-circuit transistors has a drain/collector that is connected to the string monitor and control sub-circuit. In some cases, each series-pass sub-circuit comprises a first transistor serially connected to a second transistor, and each of those series-pass sub-circuit first transistors has a gate/base that is connected to a first common node that is further connected to the string monitor and control sub-circuit, and each of those series-pass sub-circuit second transistors has a gate/base that is connected to a second common node that is further connected to the string monitor and control sub-circuit, and each of those series-pass sub-circuit first transistors has a drain/collector that is connected to the string monitor and control sub-circuit. In some cases, each current sense sub-circuit comprises a resistor having one terminal connected to the corresponding series-pass sub-circuit and another terminal for operatively coupling with a power supply. In some cases, the string monitor and control sub-circuit substantially nulls the voltage across the series-pass sub-circuit that controls a highest voltage LED string, by using a plurality of semiconductor PN junctions operatively coupled across that series-pass sub-circuit, one or more of the PN junctions having a first polarity and the other PN junctions having an opposite polarity such that the total voltage drop of the plurality of PN junctions is in the range of about −0.25 VDC to +0.25 VDC.

Another embodiment of the present invention provides a lighting apparatus. The apparatus includes a plurality of LED strings, each string having a plurality of serially coupled LEDs. The apparatus further includes a plurality of series-pass sub-circuits, each configured to control current flow through a corresponding one of the LED strings. The apparatus further includes a plurality of current sense sub-circuits, each configured to sense current flowing through a corresponding one of the LED strings. The apparatus further includes a string monitor and control sub-circuit configured to substantially null the voltage across the series-pass sub-circuit that controls a highest voltage LED string. In some cases, the voltage across the series-pass sub-circuit that controls the highest voltage LED string is nulled to be in the range of about −0.20 VDC to +0.20 VDC. In some cases, if current increases in one of the series-pass sub-circuits, the corresponding current sense sub-circuit is configured to develop a higher voltage drop thereby lowering drive voltage of that series-pass sub-circuit which in turn reduces current passed by that series-pass sub-circuit. In some cases, each series-pass sub-circuit comprises a transistor and each of those series-pass sub-circuit transistors has a gate/base that is connected to a common node that is further connected to the string monitor and control sub-circuit, and each of those series-pass sub-circuit transistors has a drain/collector that is connected to the string monitor and control sub-circuit. In some cases, each series-pass sub-circuit comprises a first transistor serially connected to a second transistor, and each of those series-pass sub-circuit first transistors has a gate/base that is connected to a first common node that is further connected to the string monitor and control sub-circuit, and each of those series-pass sub-circuit second transistors has a gate/base that is connected to a second common node that is further connected to the string monitor and control sub-circuit, and each of those series-pass sub-circuit first transistors has a drain/collector that is connected to the string monitor and control sub-circuit. In some cases, each current sense sub-circuit comprises a resistor having one terminal connected to the corresponding series-pass sub-circuit and another terminal for operatively coupling with a power supply. In some cases, the string monitor and control sub-circuit substantially nulls the voltage across the series-pass sub-circuit that controls a highest voltage LED string, by using a plurality of semiconductor PN junctions operatively coupled across that series-pass sub-circuit, one or more of the PN junctions having a first polarity and the other PN junctions having an opposite polarity such that the total voltage drop of the plurality of PN junctions is in the range of about −0.25 VDC to +0.25 VDC.

Another embodiment provides a lighting circuit. The circuit includes a power supply circuit (e.g., for converting an AC voltage to a DC voltage), and a plurality of LED strings, each string having a plurality of serially coupled LEDs. The circuit further includes means for controlling current flow through each of the LED strings, means for sensing current flowing through each of the LED strings, and means for substantially nulling the voltage across the means for controlling current flow associated with a highest voltage LED string. In some cases, the voltage across the means for controlling current flow associated with the highest voltage LED string is nulled to be in the range of about −0.20 VDC to +0.20 VDC. In some cases, each means for controlling current flow comprises a transistor having a gate/base that is connected to a common node that is further connected to the means for substantially nulling, and each of those transistors has a drain/collector that is connected to the means for substantially nulling. In some cases, each means for controlling current flow comprises a first transistor serially connected to a second transistor, and each of those first transistors has a gate/base that is connected to a first common node that is further connected to the means for substantially nulling, and each of those second transistors has a gate/base that is connected to a second common node that is further connected to the means for substantially nulling, and each of the first transistors has a drain/collector that is connected to the means for substantially nulling. In some cases, each means for sensing current comprises a resistor having one terminal connected to the corresponding means for controlling current flow and another terminal for operatively coupling with the power supply. In some cases, the means for substantially nulling comprises a plurality of semiconductor PN junctions operatively coupled across each means for controlling current flow, one or more of the PN junctions having a first polarity and the other PN junctions having an opposite polarity such that the total voltage drop of the plurality of PN junctions is in the range of about −0.25 VDC to +0.25 VDC.

The foregoing description of example embodiments of the invention has been presented for the purposes of illustration and description. It is not intended to be exhaustive or to limit the invention to the precise forms disclosed. Many modifications and variations are possible in light of this disclosure. For example, a number of examples provided here presumed silicon junctions, with a voltage drop of about 0.7 VDC. Other process technologies may provide a different voltage drop. For example, germanium devices (e.g., diodes, transistors) are typically associated with a voltage drop of about 0.3 VDC). In addition, note that depicted polarities in the example implementations shown can be reversed to yield designs that function similarly but might have advantages in certain applications. For instance, the polarities of the power supply, LEDs, and all diodes can be reversed, while all transistors are substituted with their complimentary parts (e.g., NPN transistors are replaced by PNP types, N channel MOSFETS are replaced by P channel MOSFETS, etc). Any such technologies and polarity schemes can be used to implement an embodiment of the present invention, where a minimum or otherwise reduced voltage is provided across the string current control transistor (or other suitable device/circuit). It is intended that the scope of the invention be limited not by this detailed description, but rather by the claims appended hereto.

What is claimed is:

1. A current balancing circuit, comprising:

a plurality of series-pass sub-circuits, each configured to control current flow through a corresponding LED string coupled to a positive terminal of a power supply, wherein each series-pass sub-circuit includes a transistor having its drain/collector connected to the corresponding LED string, its source/emitter connected to a corresponding current sense sub-circuit, its drain/collector connected to its gate/base via a first diode and a second diode, and its drain/collector and gate/base connected to a string monitor and control sub-circuit;

a plurality of current sense sub-circuits, each configured to sense current flowing through a corresponding LED string;

a plurality of resistors, each resistor connected in parallel to a corresponding LED string, wherein the plurality of resistors prevents current flowing through all the LED strings when at least one LED string fails; and the string monitor and control sub-circuit comprising a first resistor connected between the positive terminal of the power supply and the drain/collector and gate/base of the transistor in each series-pass sub-circuit and a second resistor connected between a negative terminal of the power supply and the drain/collector and gate/base of the transistor in each series-pass sub-circuit, wherein the string monitor and control-sub circuit is configured to null the voltage across the series-pass sub-circuit that controls a highest voltage LED string to be in the range of −0.25V to +0.25V, wherein the voltage across the series-pass sub-circuit is a serial voltage drop between a corresponding LED string and the negative terminal of the power supply.

2. The circuit of claim 1 wherein the transistor is a field effect transistor (FET) and the voltage across the series-pass sub-circuit that controls the highest voltage LED string is nulled such that the drain-source voltage of the corresponding FET is in the range of −0.20 VDC to +0.20 VDC.

3. The circuit of claim 1 wherein if current increases in one of the series-pass sub-circuits, the corresponding current sense sub-circuit is configured to develop a higher voltage drop thereby lowering drive voltage of that series-pass sub-circuit which in turn reduces current passed by that series-pass sub-circuit.

4. The circuit of claim 1 wherein each current sense sub-circuit comprises a resistor having one terminal connected to the corresponding series-pass sub-circuit and another terminal for operatively coupling with the power supply.

5. A lighting apparatus, comprising:

a plurality of LED strings, each string having a plurality of serially coupled LEDs;

a plurality of series-pass sub-circuits, each configured to control current flow through a corresponding one of the LED strings, wherein each series-pass sub-circuit includes a transistor having its drain/collector connected to the corresponding LED string, its source/emitter connected to a corresponding current sense sub-circuit, its drain/collector connected to its gate/base via a first diode and a second diode, and its drain/collector and gate/base connected to a string monitor and control sub-circuit;

a plurality of current sense sub-circuits, each configured to sense current flowing through a corresponding one of the LED strings;

a plurality of resistors, each resistor connected in parallel to a corresponding one of the LED strings, wherein the plurality of resistors prevents current flowing through the plurality of LED strings when at least one LED string fails; and the string monitor and control sub-circuit comprising a first resistor connected between a positive terminal of a power supply and the drain/collector and gate/base of the transistor in each series-pass sub-circuit and a second resistor connected between a negative terminal of the power supply and the drain/collector and gate/base of the transistor in each series-pass sub-circuit, wherein the string monitor and control-sub circuit is configured to null the voltage across the series-pass sub-circuit that controls a highest voltage LED string to be in the range of −0.25V to +0.25V, wherein the voltage across the series-pass sub-circuit is a serial voltage drop between a corresponding LED string and the negative terminal of the power supply.

6. The apparatus of claim 5 wherein the transistor is a field effect transistor (FET) and the voltage across the series-pass sub-circuit that controls the highest voltage LED string is nulled such that the drain-source voltage of the corresponding FET is in the range of −0.20 VDC to +0.20 VDC.

7. The apparatus of claim 5 wherein if current increases in one of the series-pass sub-circuits, the corresponding current sense sub-circuit is configured to develop a higher voltage drop thereby lowering drive voltage of that series-pass sub-circuit which in turn reduces current passed by that series-pass sub-circuit.

8. The apparatus of claim 5 wherein each current sense sub-circuit comprises a resistor having one terminal connected to the corresponding series-pass sub-circuit and another terminal for operatively coupling with the power supply.

* * * * *